US005303648A

United States Patent [19]

Shih

[11] Patent Number: 5,303,648

[45] Date of Patent: Apr. 19, 1994

[54] ROLLER STAMP

[76] Inventor: Shiny Shih, No. 31, Lane 349, Chung Cheng S. Rd., Yung Kang Hsiang, Tainan Hsien, Taiwan

[21] Appl. No.: 14,791

[22] Filed: Feb. 8, 1993

[51] Int. Cl.[5] ..... B41F 5/00

[52] U.S. Cl. ..... 101/329; 101/327

[58] Field of Search ..... 101/328, 329, 330, 331, 101/375, 368, 376, 377, 405, 327; 446/465; 401/208, 218

[56] References Cited

U.S. PATENT DOCUMENTS

| | | | |
|---|---|---|---|
| 587,253 | 7/1897 | Adler | 101/329 |
| 1,707,149 | 3/1929 | Stamper | 101/328 |
| 1,722,867 | 7/1929 | Testa | 101/330 |
| 2,513,419 | 7/1950 | Mann | 101/329 |
| 3,537,394 | 11/1970 | Swapp | 101/376 |
| 4,593,618 | 6/1986 | Lebensfeld | 101/405 |

*Primary Examiner*—Edgar S. Burr
*Assistant Examiner*—Ren Yan
*Attorney, Agent, or Firm*—Bell, Seltzer, Park & Gibson

[57] ABSTRACT

A roller stamp device includes a housing which is open at a lower side thereof, a front wheel assembly, a rear wheel assembly mounted to a rear portion of the housing, and an ink pad assembly. The front wheel assembly includes a wheel mounted on a front wheel axle which, in turn, is rotatably mounted to a front portion of the housing and a stamping strip placed around and secured to the periphery of the wheel. The ink pad assembly includes at least one ink pad mounted around an ink pad axle, which, in turn, is mounted to a middle portion of the housing. The ink pad axle includes a first axle section and a second axle section which are separably engaged together. The roller stamp device further has a U-shaped bumper to rotationally mount the front wheel axle and the ink pad axle to the housing.

2 Claims, 5 Drawing Sheets

ROLLER STAMP

BACKGROUND OF THE INVENTION

The present invention relates to a roller stamp and, more particularly, to a device which has a rollable stamp and a replaceable ink pad.

A toy-type stamp for children generally has a cute, interesting, or beautiful figure or character engraved on a rubber surface and the figure or character can be stamped onto any desired place. Such a toy-type stamp cannot attract children as the outlook thereof is simply a rod, rectangular handle or the like. Further disadvantages of such a toy-type stamp is that the ink pad thereof is restricted monotonously to one color, and the figure or character thereof is not interchangeable.

For this end, the invention provides a rollable stamp device having an interchangeable stamp, multicolor ink pads, and a cartoon outlook to attract users.

SUMMARY OF THE INVENTION

In accordance with one aspect of the invention, a rollable stamp device includes a housing which is open at a lower side thereof and is of a cartoon car outline, a front wheel assembly, a rear wheel assembly, and an ink pad means.

The front wheel assembly includes a wheel mounted on a front wheel axle which, in turn, is rotatably mounted to a front portion of the housing and a stamping strip placed around and secured to the periphery of the wheel. The stamping strip is preferably made of rubber or similar elastic mouldable material. The rear wheel assembly includes a rear wheel axle rotatably mounted to a rear portion of the housing and two rear wheels mounted on the rear wheel axle.

The ink pad means includes an ink pad mounted around an ink pad axle, which, in turn, is rotatably mounted to a middle portion of the housing. The ink pad is in the form of a cylinder and is preferably made of absorptive material such as foam rubber which is able to hold a supply of ink. The ink pad axle includes a first axle section and a second axle section which are separably engaged together by means of inserting a positioning pin of the second axle section into a bore formed in the first axle section. The first and second axle sections may have fence member for retaining the ink pad. More than one ink pad can be mounted on the ink pad axle, depending on the user's need. The ink pad(s) is easily interchangeable with others having different color inks or for replacement.

The roller stamp device of the invention further has a substantially U-shaped bumper means to mount the front wheel axle and the ink pad axle. The U-shaped bumper includes a bumper portion and an arm extending .from each end of the bumper portion. A peg projects from a distal end of each arm for engaging with an associated positioning hole in the middle portion of each side of the housing. Also formed in each arm are a first recess which cooperates with an arch in a front portion of each side of the housing to rotationally hold the front wheel axle therein and a second recess which cooperates with another arch in a reinforced member in a middle portion of each side of the housing to rotationally hold the ink pad axle. The U-shaped bumper means further has a flexible snapping member with a snapping head for releasably engaging with a cutout in a front edge of the housing. After assembling, the surface of the ink pad contacts with the stamping strip to supply ink to the engraved portion on the periphery of the stamping strip.

In use, the user may urge the device in either direction, the ink pad is continuously inking the stamping strip such that the inking is done in a consistent and continuous manner to leave a desired stamped effect.

To realize the above advantages, a study should be made of the following detailed description with appropriate reference being made to the accompanying drawings.

DETAILED DESCRIPTION OF THE PREFERRED EMBODIMENT

Figure 1:
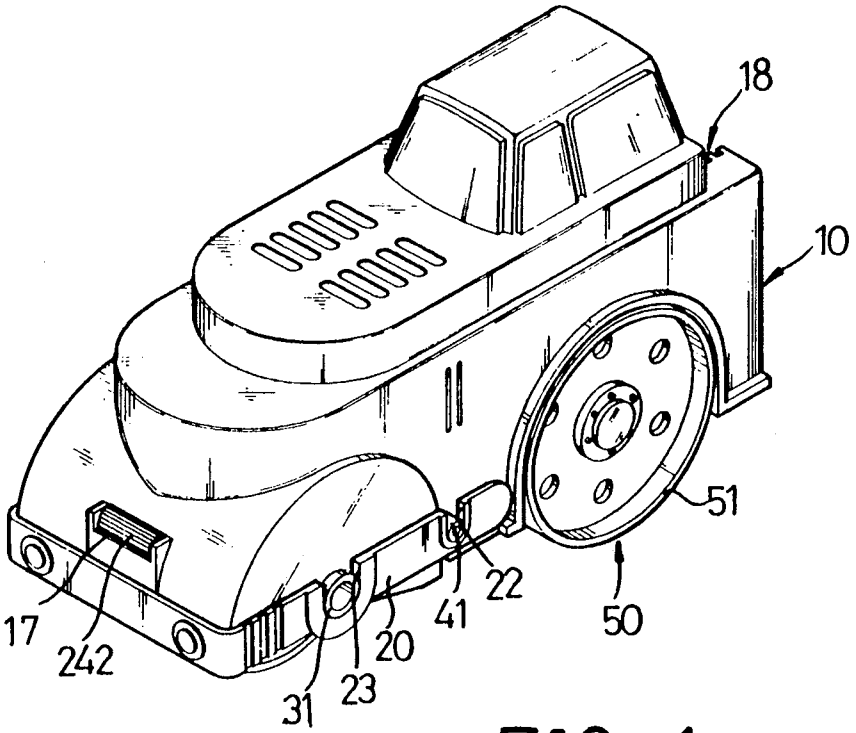
FIG. 1 is a perspective view of a roller stamp device in accordance with the present invention.
Figure 2:
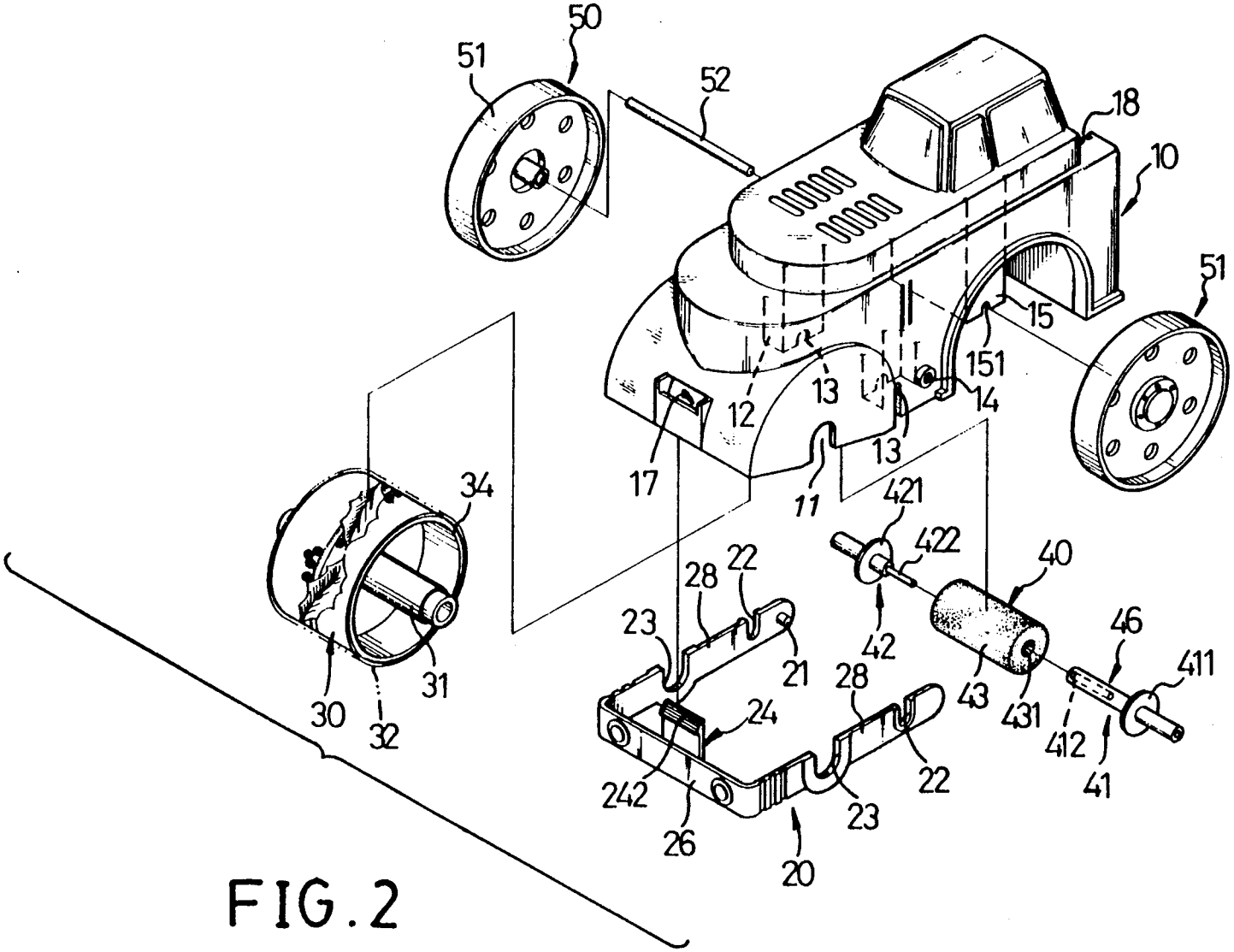
FIG. 2 is an exploded view of the roller stamp device.

Referring to the drawings, initially to FIGS. 1 and 2, a roller stamp device is shown in a preferred embodiment in accordance with the present invention and generally comprises a housing 10 of a cartoon outline, such as a cute car as shown in the drawings. The housing 10 is open at a lower side thereof. The roller stamp device further has a front wheel assembly 30, a rear wheel assembly 50, and an ink pad means 40.

The front wheel assembly 30 includes a wheel 34 mounted on a front wheel axle 31 which, in turn, is rotatably mounted to a front portion of the housing 10, which will be discussed later, and a stamping strip 32 placed around and secured to the periphery of the wheel 34. The stamping strip is preferably made of rubber or similar elastic mouldable material. The rear wheel assembly 50 includes a rear wheel axle 52 rotatably mounted to a rear portion of the housing 10 and two rear wheels 51 mounted on the rear wheel shaft 52. In this embodiment, the rear wheel axle 52 is mounted to a C-shaped groove 151 in a reinforced member 15 at the rear portion of the housing 10. The housing 10 has an arch 16 at a rear portion of each side thereof to receive an associated rear wheel 51.

Figure 3:
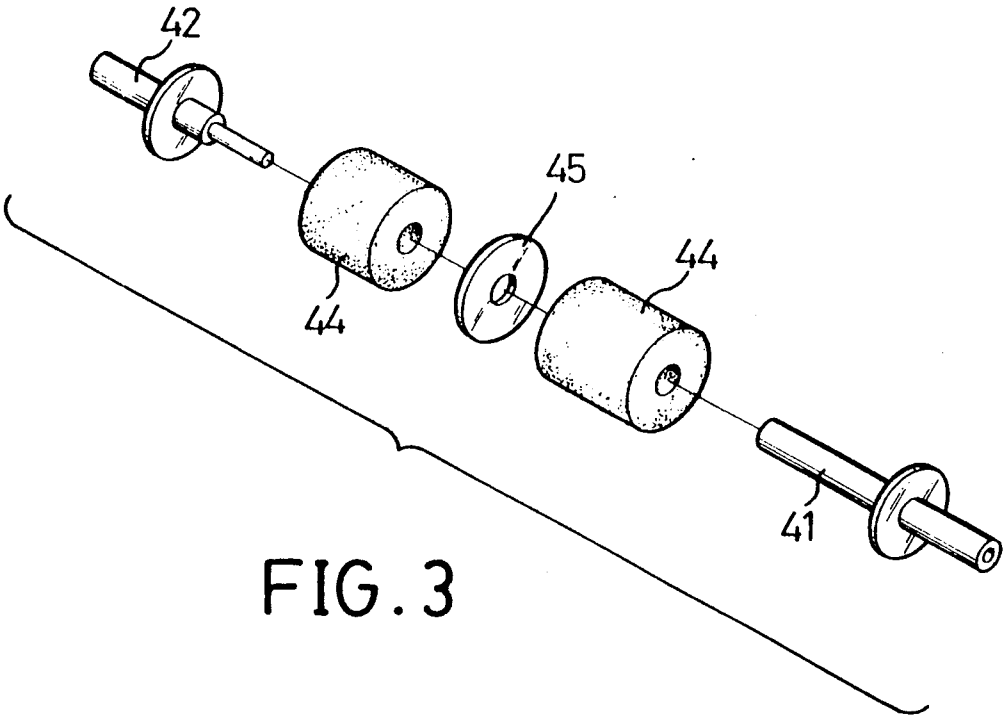
FIG. 3 is an exploded view showing another embodiment of the ink pad means.

The ink pad means 40 includes an ink pad 43 mounted around an ink pad axle 46, which, in turn, is mounted to a middle portion of the housing 10. The ink pad 43 is in the form of a cylinder and is preferably made of absorptive material such as foam rubber which is able to hold a supply of ink. The ink pad axle 46 includes a first axle section 41 and a second axle section 42 which are separably engaged together by means of inserting a positioning pin 422 of the second axle section 42 into a bore 412 formed in the first axle section 41. The first and second axle sections 41 and 42 may have flange member 411 and 421 for retaining the ink pad 43. FIG. 3 shows another embodiment of the ink pad axle in which two ink pads 44, which are of different colors and spaced by a washer 45, are provided to provide a colorful stamping effect. It is appreciated that more than two ink pads can be used. As clearly shown in FIGS. 2 and 3, the ink pad(s) 44 is easily interchangeable with others having different color inks or for replacement.

The roller stamp device of the invention further has a substantially U-shaped bumper means 20 to mount the front wheel axle 31 and the ink pad axle 46. The U-shaped bumper means 20 includes a bumper portion 26 and an arm 28 extending from each end of the bumper portion 26. A peg 21 projecting from a distal end of each arm 28 for engaging with an associated positioning hole 14 in the middle portion of each side of the housing 10. Also formed in each arm 28 are a first recess 23 which cooperates with an arch 11 in a front portion of each side of the housing 10 to rotationally hold the front wheel axle 31 therein and a second recess 22 which cooperates with another arch 13 in a reinforced member 12 in a middle portion of each side of the housing 10 to rotationally hold the ink pad axle 46. A flexible snapping member 24 with a snapping head 242 extends upward from the bumper portion 26 for releasably engaging with a cutout 17 in a front edge of the housing 10.

Figure 4:
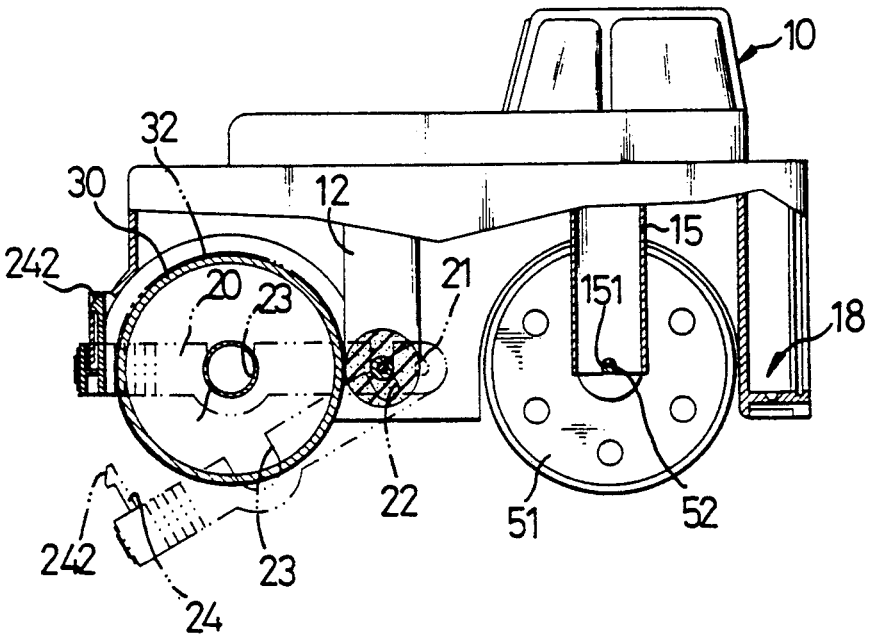
FIG. 4 is a side elevational view, partly sectioned, of the roller stamp device, showing the mounting of a U-shaped bumper means.
Figure 5:
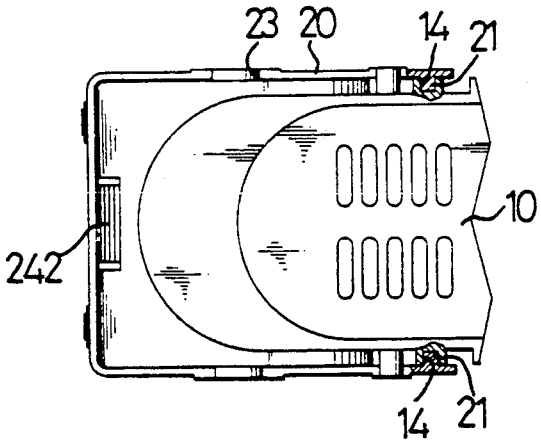
FIG. 5 is a partial top plan view, partly sectioned of the roller stamp device.

When assembling, the front wheel assembly 30 and the ink pad means 20 are located by respectively putting the front wheel axle 31 and the ink pad axle 46 into the arches 11 and 13 via the lower open side of the housing 10. Thereafter, the pegs 21 of the U-shaped bumper 20 are inserted into the positioning holes 14 and then pivots the bumper 20 until the snapping head 242 of the snapping member 24 engages with the cutout 17, the recesses 23 and 22 respectively cooperate with the arches 11 and 13 to securely yet rotationally hold the front wheel axle 31 and the ink pad axle 46, as shown in FIGS. 4 and 5. The rear wheel assembly can be independently assembled. After the assembling, the surface of the ink pad 44 contacts with the stamping strip 32 to supply ink to the engraved or moulded portion on the periphery of the stamping strip 32.

Figure 6:
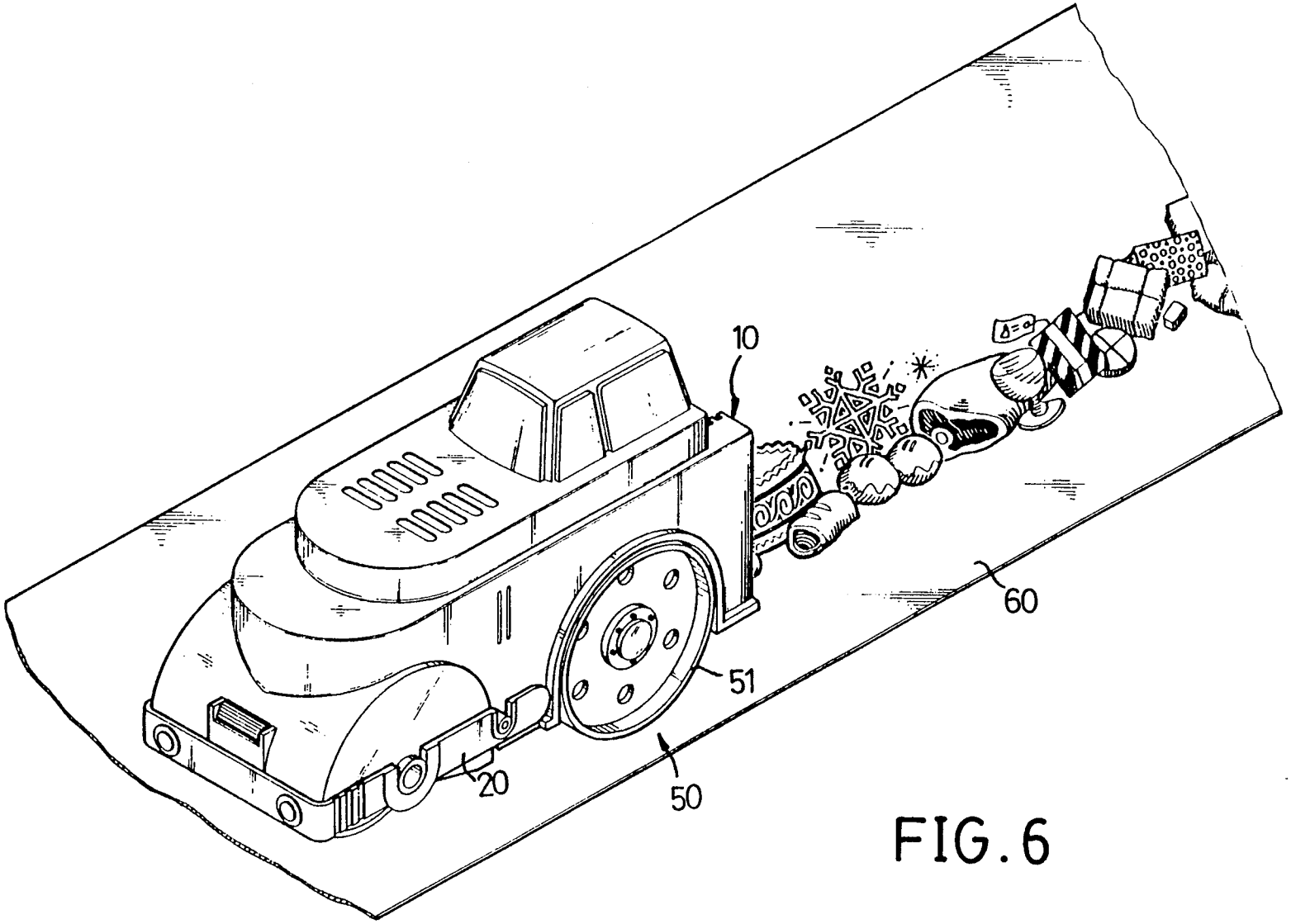
FIG. 6 is a perspective view of the roller stamp device shown in a preferable working embodiment.

In use, a user holds the housing 10 and then pushes the device in either direction, and thus leaves a desired stamp on a paper 60, as shown in FIG. 6. As can be realized, the stamping strip 32 may be engraved or moulded with any desired pattern, picture, message, etc.

While a preferred embodiment has been described, further embodiments will become apparent to someone skilled in this related art. All possible embodiments are intended to fall within the scope of this specification and as outlined in the following claims.

I claim:

1. A stamping device comprising:

a housing having a lower open end, opposite sides, a positioning hole in a middle portion of each of said sides, a first arch in a front portion of each of said sides, and a second arch in each of said sides and between said positioning hole and said first arch thereof;

a rear wheel assembly mounted to a rear portion of said housing;

a front wheel assembly comprising a front wheel axle, a wheel mounted on said front wheel axle, and a stamping strip placed around and secured to a periphery of said wheel, said stamping strip having a desired pattern therein;

an ink pad means comprising an ink pad axle and an ink pad mounted on said ink pad axle, said ink pad axle comprising a first axle section with a bore and a second axle section with a pin for separably engaging with said bore, said ink pad contacting said pattern of said stamping strip; and a substantially U-shaped bumper means for mounting said front wheel axle and said ink pad axle to said housing; said U-shaped bumper means comprising a bumper portion having two ends and an arm extending from each said end of said bumper portion, each said arm having a peg extending from a distal end thereof for engaging with said positioning hole of one of said sides of said housing, a first recess which cooperates with said first arch of said one side to rotationally hold said front wheel axle therein, and a second recess which cooperates with said second arch of said one side to rotationally hold said ink pad axle.

2. The stamping device as claimed in claim 1, wherein said housing has a cutout in a front edge thereof and said bumper portion of said bumper means has a flexible snapping member with a snapping head for releasably engaging with said cutout.

* * * * *